US005281321A

United States Patent [19]

Stürmer et al.

[11] Patent Number: 5,281,321

[45] Date of Patent: Jan. 25, 1994

[54] DEVICE FOR THE SUPPRESSION OF ARCS

[75] Inventors: Johann Stürmer, Freigericht; Götz Teschner, Gelnhausen, both of Fed. Rep. of Germany

[73] Assignee: Leybold Aktiengesellschaft, Hanau, Fed. Rep. of Germany

[21] Appl. No.: 23,477

[22] Filed: Feb. 25, 1993

Related U.S. Application Data

[63] Continuation of Ser. No. 807,266, Dec. 13, 1991, abandoned.

[30] Foreign Application Priority Data

Aug. 20, 1991 [DE] Fed. Rep. of Germany ..... 4127505

[51] Int. Cl.[5] ..... C23C 14/34

[52] U.S. Cl. ..... 204/298.08; 204/298.26; 204/298.41; 204/192.12

[58] Field of Search ..... 204/192.38, 192.12, 204/298.08, 298.41, 298.26; 118/723; 427/562, 580

[56] References Cited

U.S. PATENT DOCUMENTS 4,919,968 4/1990 Buhl et al. ..... 204/298.41 X
4,936,960 6/1990 Siefkes et al. ..... 264/192.38

FOREIGN PATENT DOCUMENTS 0018242 2/1968 Japan ..... 204/298.41
0207573 9/1986 Japan ..... 204/298.08
0190168 8/1988 Japan ..... 204/298.08
2045553 10/1980 United Kingdom ..... 204/298.08

OTHER PUBLICATIONS

"The MDX as a Strategic Tool in Reducing Arcing" by Douglas S. Schatz in 1985.

*Primary Examiner*—Nam Nguyen
*Attorney, Agent, or Firm*—Koda and Androlia

[57] ABSTRACT

The invention relates to a device for the suppression of arcs in gas discharge arrangements having two cathodes (6, 7) and one anode (4) supplied from an electric energy source (10). Between the electrical terminals of this electric energy source (10) and the cathode (6, 7) is provided a circuit configuration having two switching elements (15, 25) which upon the occurrence of arcs are through-switched.

19 Claims, 3 Drawing Sheets

DEVICE FOR THE SUPPRESSION OF ARCS

This is a continuation of application Ser. No. 807,266, filed Dec. 13, 1991, now abandoned.

The invention relates to an arc suppression circuit according the Preamble of Patent claim 1.

In gas discharge technique it is often required to generate a plasma from a gas without causing arc discharges. For example, in the coating of glass in which $SiO_2$ is applied by sputtering onto a carrier material, a so-called substrate, no flashovers must occur because otherwise the target as well as also the substrate are destroyed. Because of the numerous physical causes which can lead to an arc discharge it is extremely difficult to prevent the arc discharge as such. However, it is possible to suppress the formation of an arc discharge of high current strength.

Special problems are encountered in sputtering installations having two cathodes and being supplied with alternating current. In these installations the polarities at the cathodes or the anodes, respectively, change continuously. If for two cathodes only one anode is provided it is potentially possible for arc discharges to jump continuously from one cathode to the other.

As closer investigations of arc discharges have shown not all discharges lead to the immediate breakdown of the insulating capability. Rather, voltage traces occur in which the breakdown of the arc firing voltage takes place a few milliseconds after a first return of the voltage to 150 to 300 V. These voltage breakdowns developing in stages are not recognized by simple oscillating circuits which are customarily used for quenching. Due to their long burn time and their high energy content connected therewith the multistage arcs lead rapidly to the destruction of the target surface.

In a known cathode arc coating method in which an arc impinges on a target and there knocks out charged particles which reach a substrate, the impedance between the electrodes between which the arc forms decreases very strongly. In order to increase this impedance again at the end of a working process it is known to draw off with an appropriate electrical potential the particles knocked out of the target more strongly in the direction of the substrate U.S. Pat. No. 4,936,960). However, the disadvantage of this known method is that it can only be applied in the case of arc coatings as well as direct current between the arc electrodes, on the one hand, and the target or substrate, on the other. For an arrangement with two electrodes the known method for the impedance increase and consequently, for quenching arcs is also not suitable. The conventional method to suppress arcing therefore resides in switching off the current supply for a given length of time.

It is furthermore known upon the occurrence of an arc discharge to supply an installation with the least amount of energy possible or to suppress the energy supply entirely. Therein the energy supply is to remain suppressed until the entire zone around the arc discharge has become stabilized (D.S. Schatz, the MDX as a Strategic Tool in Reducing Arcing, Publication of the Advanced Energy Industries, Inc., 1985). A further known measure for decreasing the probability of arcing resides in decreasing the ripples of the energy supply and specifically over the entire impedance range. Application of faster regulating devices has also been suggested in order to rapidly adapt the deviations from the nominal value of the supply voltage (D. S. Schatz, op. cit.). To quench arcs a reversing circuit has been suggested such as is customary in the thyristor technique.

The invention is based on the task of creating an improved circuit configuration for quenching arcs in plasma arrangements.

This task is solved according to the features of Patent claim 1.

The advantage achieved with the invention resides in particular therein that even when sputtering difficult materials, for example $SiO_2$, high coating rates are possible because the sputtering process is only interrupted for a very short time. When sputtering $SiO_2$, Si atoms are knocked out from a target of highest grade silicon disposed in an argon/oxygen atmosphere of $10^{-3}$ to $10^{-1}$ mbars, which combine with oxygen to form $SiO_2$ which is deposited on a substrate.

The invention can be used preferably in plasma installations operated with alternating current. It can, however, also be used in installations which have only one cathode and are operated with direct current. The cathode in such a case is opposed by a separate anode or a vessel wall functioning as anode.

Application of the invention to three-phase alternating current operation is also possible if six electronic switches with a separate electronic firing system are provided.

A further particularity of the invention resides therein that the instantaneous voltage is compared with a capacitor voltage and through the arrangement of a firing circuit is protected so that always the correct electronic switch is opened or closed, respectively.

BRIEF DESCRIPTION OF THE DRAWINGS

An embodiment example of the invention is depicted schematically in the drawing and is described in the following in further detail. Therein show.

DETAILED DESCRIPTION OF THE DRAWINGS

Figure 1:
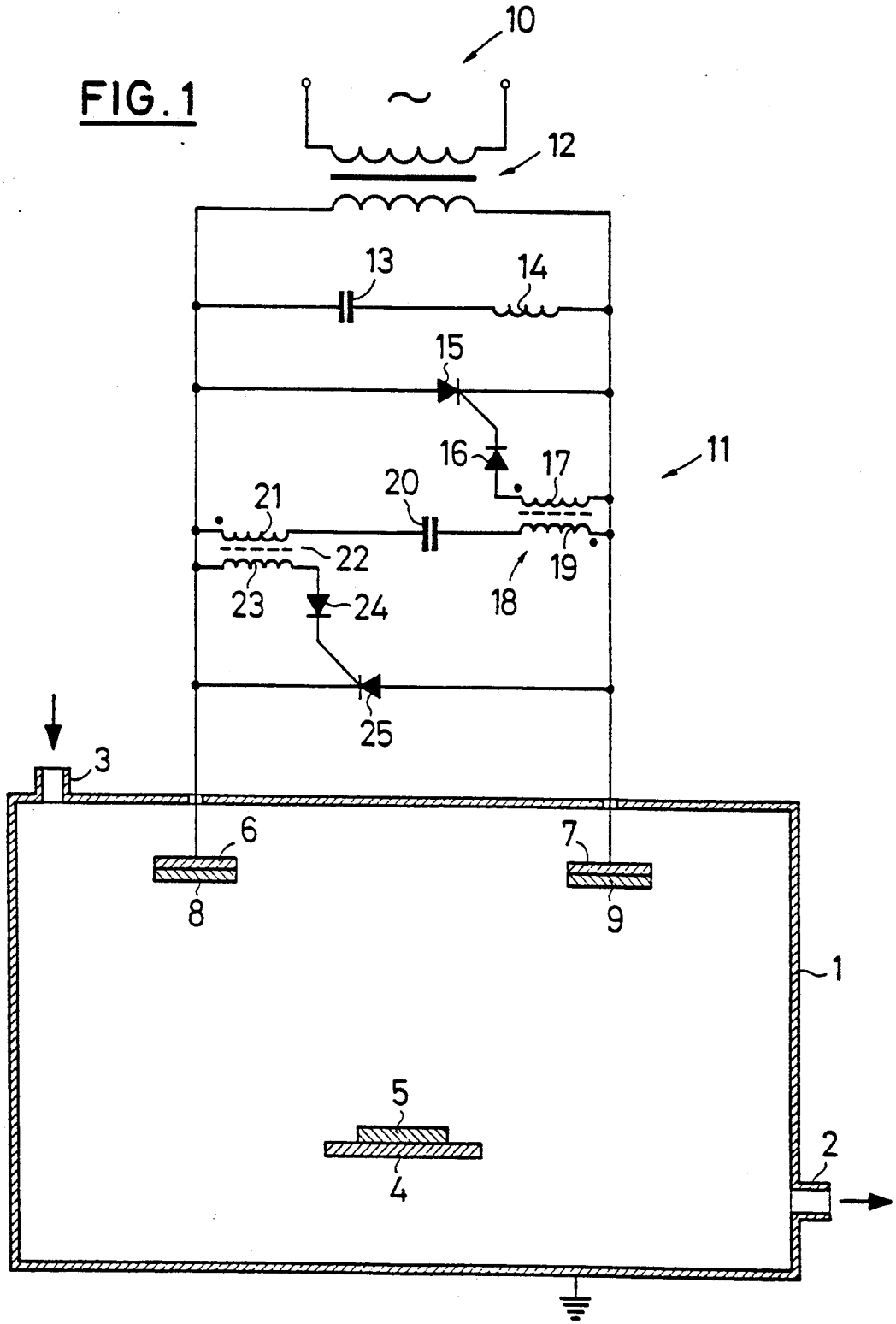
FIG. 1 a sputtering installation with a thyristor configuration for switching-off an energy supply.

In FIG. 1 is depicted a vacuum chamber 1 having a port 2 for the evacuation of the chamber and a port 3 for the feeding of gases. In the chamber 1 is located a substrate holder 4, on which is disposed a substrate 5. The substrate 5 comprises, for example, glass or a synthetic film or a silicon wafer of microelectronic fabrication. Above the substrate 5 and next to one another are provided two electrodes 6, 7 which each carry a target 8, 9. These targets comprise, for example, highest grade silicon in poly- or monocrystalline form. Other, and in each instance different, materials for the two targets 8, 9 are also conceivable. Both electrodes 6, 7 are supplied from an alternating current source 10 wherein between this alternating current source 10 and the electrodes 6, 7 a special circuit configuration 11 is disposed. This circuit configuration has a transformer 12 connected with the alternating current source 10, to whose secondary winding a series circuit comprising a capacitor 13 and a coil 14 is connected in parallel. In parallel with this series circuit is a thyristor 15, the cathode of which is connected with the coil 14 and the anode of which is connected with the capacitor 13. The control electrode of this thyristor 15 is connected with the cathode of a diode 16 whose anode is coupled with a terminal of a primary winding 17 of a transformer 18, whose secondary winding 19 is a part of a series circuit which further has a capacitor 20 and a primary winding 21 of a further transformer 22. The secondary winding 23 of this further transformer 22 is connected, on the one hand, with the primary winding 21 and the capacitor 13 and, on the other hand, with the anode of a diode 24. The cathode of this diode 24 is connected to the control electrode of a thyristor 25 whose cathode is connected with the electrode 6 and whose anode is connected with electrode 7.

An arc discharge in which occurs a burn voltage between the grounded substrate carrier 4 and the electrodes 6, 7 of 20 V and a current exceeding all limits is essentially avoided through the circuit configuration 11 thereby that this increasing current is isolated from the gas discharge by the thyristors 15 and 25 and that through the firing of a thyristor 15, 25 the quenching oscillating circuit comprising coil 14 and capacitor 13, is reliably excited to reverse oscillation and, consequently, to the quenching of the current. Since the burn voltage of the thyristors is below 2 V, reliable draining of the current is ensured.

The arc discharge comprises an arc between defined cathodes 6 or 7 and anode 4 wherein the current of the arc is first limited by the external circuit 11. During the initial interval of an arc a hot spot is generated on the target 8, 9 with a diffuse end in the plasma. The sooner this hot spot can be recognized by a voltage return, the less is the energy which has flown into it and, consequently, the less the probability that destruction occurs through arcing.

The substrate carrier 4 has a galvanic connection to the sputtering current circuit. For the operating principle of the invention it is insignificant whether or not the substrate carrier 4 is connected to the housing 1, i.e. whether it is at the ground conductor potential or whether it adapts through the coupling to the plasma to a changing potential ("floating potential"). It is customary in $SiO_2$ sputtering to avoid a direct electrical connection of the sputtering current circuit with a ground conductor. The arcs between the electrodes 6 and 7 and the substrate carrier 4 thereby are possible only circuitously and are, accordingly, of low energy.

In alternating current operation, such as is depicted in FIG. 1, in contrast, a difficulty resides therein that the polarity of the electrodes 6, 7 changes after each half-wave of the applied alternating voltage. For the arc quenching therefore the in each instance correctly poled thyristor of the two thyristors 15, 25 connected antiparallel must be fired. This takes place thereby that the voltage breakdown over the capacitor 20 is differentiated and in the two transformers 18, 22 converted into a firing pulse for the two thyristors 15, 25. In cooperation with the thyristors 15, 25 the diodes 16 and 24 ensure that only a positive pulse can fire that thyristor which at the instance of the voltage breakdown has a positive anode voltage. Depending on the time of the firing the quenching of the fired thyristors 15, 25 takes place either through the passage through zero of the alternating voltage or thereby that a forced commutation circuit comprising the coil 14 and the capacitor 13, through the firing of a thyristor 15, 25 is triggered into reversing oscillation.

Figure 2:
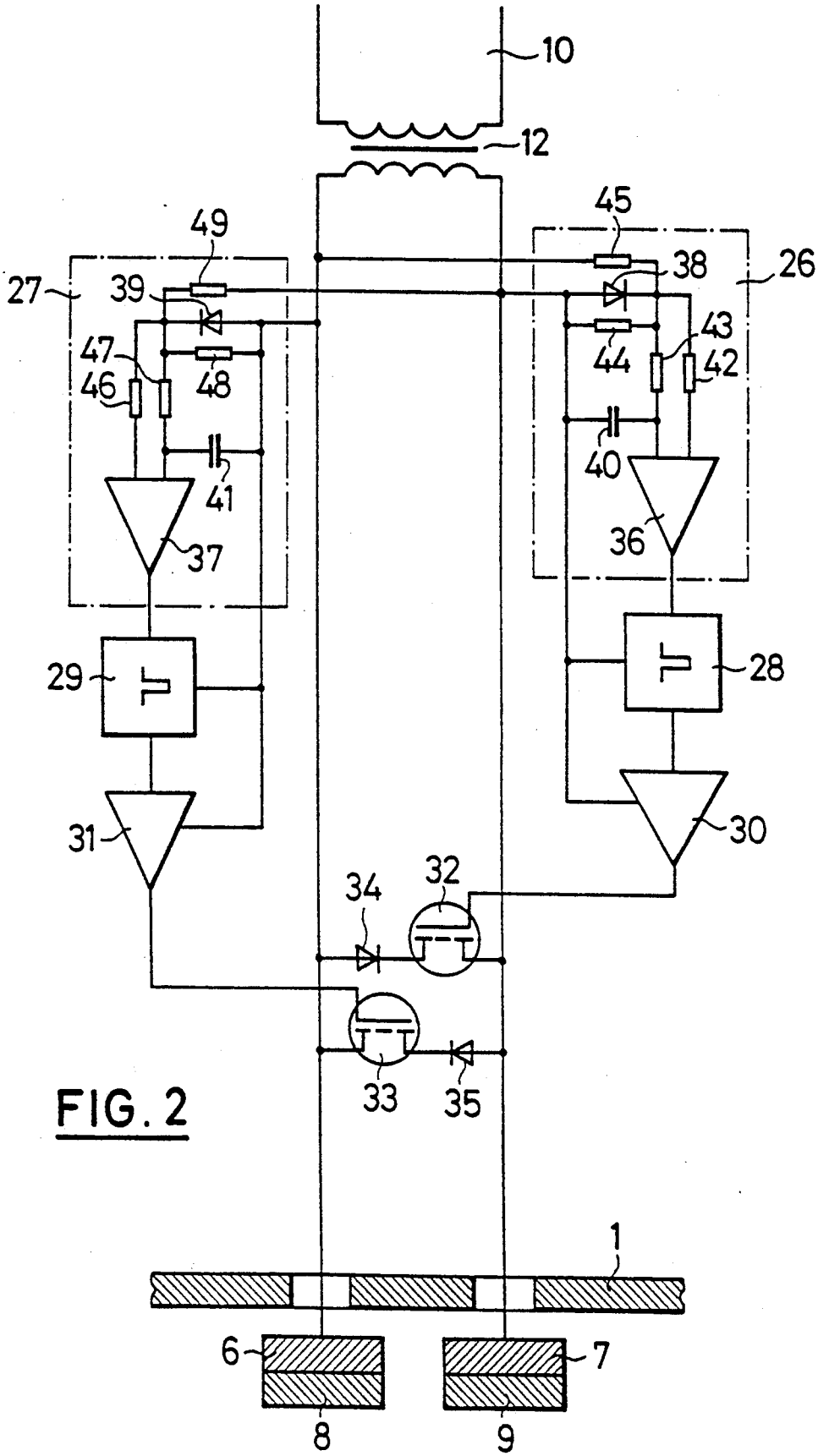
FIG. 2 a switch-off configuration with a field effect transistor switch.

In FIG. 2 is depicted a circuit configuration for the suppression of arcs which has field effect transistors as switching elements instead of thyristors.

By 26 and 27 are denoted in each instance a du/dt trigger circuit which is connected to the secondary winding of transformer 12. Each of these trigger circuits 26, 27 drives a pulse-former stage 28, 29 which outputs a single pulse for each arc. The pulses are placed, via in each instance a matching and a potential isolating amplifier 30, 31, onto the control electrodes of power field effect transistors 32, 33 which are between the two electrodes 6, 7 and are connected with in each instance one electrode 6 or 7 respectively via a diode 34 or 35, respectively. Herein the two diodes 34, 35 which prevent the inverse operation of the transistors 32, 33 are connected antiparallel wherein the anode of diode 35 is connected to electrode 7 and the anode of diode 34 to electrode 6.

The trigger circuits 26, 27 have each an operational amplifier 36, 37, a diode 38, 39, a capacitor 40, 41, and four resistors 42 to 45 or 46 to 49, respectively. The diodes are connected with their anodes to the secondary side of transformer 12 and with their cathodes to the amplifiers 36, 37.

Figure 3:
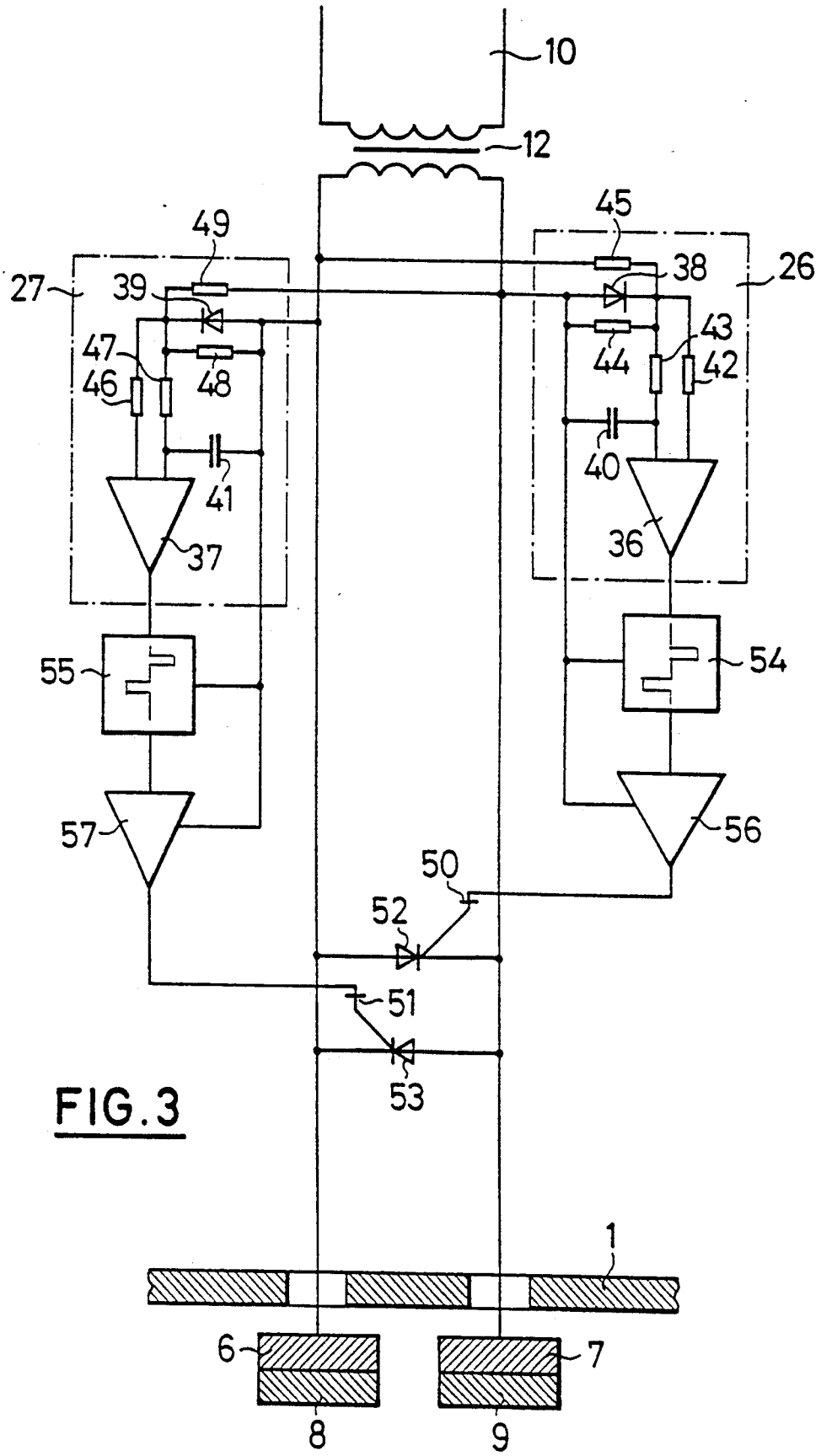
FIG. 3 a switch-off configuration with GTO or switch-off thyristors.

In FIG. 3 is depicted a further variant of the configuration according to the invention in which Gate Turn Off (GTO) thyristors are used as switching elements.

The driver circuits for the control electrodes 50, 51 of the GTO thyristors 52, 53 are built similar to the driver circuits for the control electrode of the field effect transistors 32, 33 according to FIG. 2. They also have trigger circuits 26, 27 which, however, output their voltage pulses to pulse-former stages 54, 55 which generate two pulses of which the one has negative and the succeeding pulse positive polarity. These two pulses serve for firing and quenching the GTO thyristors 52, 53. Between the pulse-former stages 54, 55 and the control electrodes 50, 51 of the GTO thyristors 52, 53 matching and isolating amplifiers 56, 57 are provided.

We claim:

1. A device for the suppression of arcs in gas discharge arrangements, comprising:

a housing (1) with an anode (4) and two cathodes (8, 9), said cathodes (8, 9) having a distance from each other and each of them being arranged at a distance from said anode (4), said distance being equal;

an electrical connection between a first of said cathodes (6) with a first potential of an alternating current source (12);

an electrical connection between a second of said cathodes (7) with a second potential of said alternating current source (12);

a first electrical connection between said first cathode (6) and said second cathode (7) comprising a unidirectional short-circuitable-element (15) which allows a current-flow in a first direction;

a second electrical connection between said first cathode (6) and said second cathode (7) comprising a second unidirectional short-circuitable-element (25) which allows a current-flow in a second direction, said second direction being opposite to said first direction; and means (20, 26, 27) for the recognition of arc discharges which through-connect said short-circuitable elements (15, 25).

2. Device as stated in claim 1, characterized in that between the first and second cathodes (6, 7) and the anode (4) a plasma is formed.

3. Device as stated in claim 1, characterized in that an arrangement (20) is provided for the recognition of arc discharges which through-connects one of the first and second short-circuitable elements (15, 25) according to a polarity of an alternating current halfwave present.

4. Device as stated in claim 3, characterized in that the arrangement for the recognition of arc discharges is a capacitor (20) disposed in a parallel branch to the cathodes (6, 7).

5. Device as stated in claim 4, characterized in that in series with the capacitor (20) is in each instance a winding (19, 21) of transformers (18, 22) whose in each instance other winding (17 or 23, respectively) is connected with a control electrode of one of the two thyristors (15, 25).

6. Device as stated in claim 5, characterized in that between the control electrode of a thyristor (15, 25) and a winding (17, 23) of a transformer (18, 22) a diode (16, 24) is connected.

7. Device as stated in claim 4, characterized in that in series with the capacitor (20) is in each instance a winding (19, 21) of transformers (18, 22) whose in each instance other winding (17 or 23, respectively) is connected with a control electrode of one of the two thyristors (15, 25).

8. Device as stated in claim 7, characterized in that between the control electrode of a thyristor (15, 25) and a winding (17, 23) of a transformer (18, 22) a diode (16, 24) is connected.

9. Device as stated in claim 3, characterized in that the arrangement for the recognition of arc discharges is a trigger circuit (26, 27) connected to the voltage source (10) and outputs pulses for driving electrical switches (32, 33).

10. Device as stated in claim 9, characterized in that the pulses are monopolar.

11. Device as stated in claim 9, characterized in that the pulses are bipolar.

12. Device as stated in claim 1, characterized in that the first and second short-circuitable elements comprise controllable semiconductor elements (15, 25).

13. Device as stated in claim 12, characterized in that the controllable semiconductor elements are thyristors (15, 25).

14. Device as stated in claim 13, characterized in that in parallel to the two thyristors (15, 25) is provided a forced commutation circuit.

15. Device as stated in claim 14, characterized in that the forced commutation circuit comprises a series circuit of a capacitor (13) and a coil (14).

16. Device as stated in claim 13, characterized in that in series with a capacitor (20) which is disposed in a parallel branch to the electrodes (6, 7) is in each instance a winding (19, 21) of transformers (18, 22) whose in each instance other winding (17 or 23, respectively) is connected with a control electrode of one of the two thyristors (15, 22).

17. Device as stated in claim 12, characterized in that the controllable semiconductors are transistors (33, 34).

18. Device as stated in claim 12, characterized in that the controllable semiconductors are gate turn off thyristors (52, 53).

19. Device as stated in claim 1, characterized in that the gas discharge arrangement is a sputtering installation.

* * * * *